US008650723B2

(12) United States Patent
Reiter

(10) Patent No.: US 8,650,723 B2
(45) Date of Patent: Feb. 18, 2014

(54) NON-ROTATABLE SNAP FASTENERS

(75) Inventor: Howard J. Reiter, Orange, CT (US)

(73) Assignee: Rome Fastener Corporation, Milford, CT (US)

( * ) Notice: Subject to any disclaimer, the term of this patent is extended or adjusted under 35 U.S.C. 154(b) by 544 days.

(21) Appl. No.: 12/583,401

(22) Filed: Aug. 20, 2009

(65) Prior Publication Data

US 2011/0041295 A1 Feb. 24, 2011

(51) Int. Cl.
*A44B 17/00* (2006.01)

(52) U.S. Cl.
USPC ..... 24/303; 24/675; 24/676; 24/108

(58) Field of Classification Search
USPC ..... 24/674, 675, 676, 104, 107, 108, 109, 24/303
See application file for complete search history.

(56) References Cited

U.S. PATENT DOCUMENTS

| | | | | | |
|---|---|---|---|---|---|
| 1,445,618 | A * | 2/1923 | Keferstein | ..... | 24/676 |
| 2,070,162 | A * | 2/1937 | Friedrich et al. | ..... | 24/108 |
| 2,615,227 | A * | 10/1952 | Hornik | ..... | 24/303 |
| 5,377,392 | A * | 1/1995 | Morita | ..... | 24/303 |
| 5,432,986 | A * | 7/1995 | Sexton | ..... | 24/303 |
| 5,515,581 | A * | 5/1996 | Kaufmann | ..... | 24/303 |
| 6,019,019 | A * | 2/2000 | Hobbs | ..... | 81/177.2 |
| 6,374,709 | B1 * | 4/2002 | Vasichek et al. | ..... | 81/125 |
| 6,640,398 | B2 * | 11/2003 | Hoffman | ..... | 24/303 |
| 6,647,597 | B2 * | 11/2003 | Reiter | ..... | 24/303 |
| 6,836,935 | B2 * | 1/2005 | Reiter | ..... | 24/303 |
| 6,925,914 | B2 * | 8/2005 | Hsien | ..... | 81/125 |
| 7,207,091 | B2 * | 4/2007 | Dunaye | ..... | 24/303 |
| 7,856,697 | B2 * | 12/2010 | Quimod | ..... | 24/113 R |
| 2011/0047759 | A1 * | 3/2011 | Reiter | ..... | 24/303 |

* cited by examiner

*Primary Examiner* — Robert J Sandy
*Assistant Examiner* — Michael Lee
(74) *Attorney, Agent, or Firm* — Cooper & Dunham LLP

(57) ABSTRACT

A snap fastener includes a male component and a female component. In a mechanical fastener, a shaft having an enlarged tip fits within a socket having a retaining element for releasably holding the enlarged tip. In a magnetic snap fastener, the female component has a magnet and a cover with a central hole for receiving the shaft. In both forms of snap fasteners, the male component and female component have anti-rotation surfaces, which interact to prevent rotation of the male and female components relative to each other.

13 Claims, 5 Drawing Sheets

NON-ROTATABLE SNAP FASTENERS

TECHNICAL FIELD

This invention relates to mechanical snap fasteners and magnetic snap fasteners. The fasteners are attached to sheet materials, bags, garments, and other articles and have anti-rotation surfaces for preventing unwanted rotation of the fastener components relative to each other.

BACKGROUND OF THE INVENTION

Mechanical and magnetic snap fasteners are commonly used to attach one material to another in articles such as clothing, bags, purses, shoes, and the like. Mechanical snap fasteners typically consist of a male component comprising a cylindrial stud having an enlarged tip and a female component comprising a socket having a retaining feature which engages with the enlarged tip of the stud. The male and female components are attached to different materials desired to be attached to one another.

In a typical magnetic snap fastener, a female component with a magnet is attached to one material and a male component attracted to the magnet is attached to another material. The two components are magnetically attracted to each other and releasably fasten the materials together.

Conventional fasteners, however, do not provide any resistance to the rotation of one component relative to the other, or one material relative to the other, as this functionality is not always required. There are circumstances, however, in which it is desired that the fastener components or materials to be fastened are held in a particular rotational relationship to one another when fastened. Conventionally, such rotational fixation has been achieved by providing two or more fasteners spaced apart on the materials to be fastened. However, such a solution is costly because it requires more than one fastener set and is not suited to a situation in which a limited amount of space on a material is available for fastening components.

Thus, there is a need for a compact, cost effective fastener for releasably fixing materials together in a rotationally restrained manner.

BRIEF SUMMARY OF THE INVENTION

In one embodiment, a mechanical snap fastener comprises a male component which has a base, an anti-rotation surface and a shaft, the shaft having an enlarged tip. The fastener also comprises a female component having a socket body, an anti-rotation surface and a retaining element for a releasably holding the enlarged tip of the shaft. The socket body has a central hole configured to receive the shaft and into which the retaining element protrudes. The male component is adapted to be attached to a first material and the female component is adapted to be attached to a second material. The anti-rotation surface on the male component and the anti-rotation surface on the female component are configured to interact to prevent rotation of the male component relative to the female component when fastened together.

In another embodiment, a magnetic snap fastener comprises a male component which has a plate, an anti-rotation surface and a shaft. The fastener also comprises a female component having a magnet and a cover with an anti-rotation surface. The shaft of the male component is received in a central hole of the female component. The male component is adapted to be attached to a first material and the female component is adapted to be attached to a second material. The anti-rotation surface of the male component and the anti-rotation surface of the female component are configured to interact with each other to prevent rotation of the male component relative to the female component, and rotation of the respective materials to which they are attached.

Various additional features may be included in the snap fasteners. For example, the edges of the anti-rotation surfaces may be curved, the anti-rotation surfaces may be configured to allow more than one indexed fastening position, and or the anti-rotation surfaces may be configured so are not to allow the snap fastener to be fastened if the shaft and socket are not in an indexed position relative to each other.

Further, a cap or ornament may be provided for one or both of the male and female components.

BRIEF DESCRIPTION OF THE DRAWINGS

The features of the present application can be more readily understood from the following detailed description with reference to the accompanying drawings wherein.

DETAILED DESCRIPTION

Figure 1:
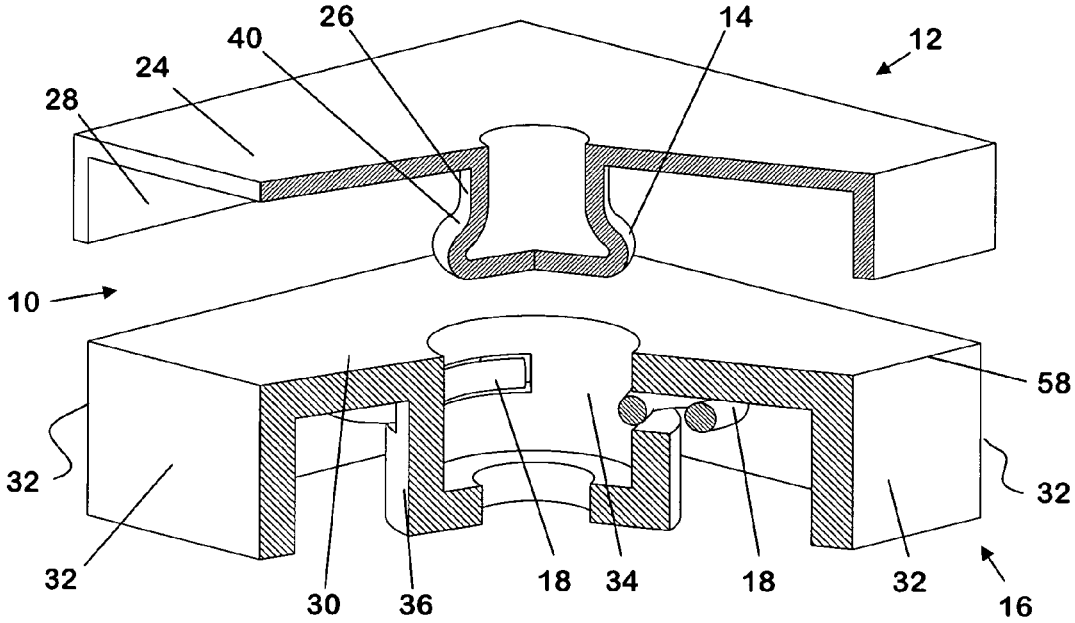
FIG. 1 is a cross sectional view of an exemplary mechanical snap fastener in accordance with the present invention.

Referring now to the drawings, and in particular to FIG. 1, an example of a mechanical snap fastener 10 in accordance with the invention comprises a male component 12 having a shaft with 26 enlarged tip portion 14. The fastener also comprises a female component 16 for engaging and releasably holding the enlarged tip portion 14 of the male component 12. The male component 12 and female component 16 are each attached to sheets of material 20 and 22 to releasably fasten the sheets of material together.

The male component 12 comprises a base 24 and a cylindrical shaft 26, the shaft having the enlarged tip 14. The male component 12 also comprises at least one anti-rotation surface 28. When comprised of a formable material such as brass, the male component 12 may be formed by drawing the shaft 26 from a flat plate and deforming the tip 14 to have a greater diameter than the rest of the shaft 26. The anti-rotation surface 28 may be formed by bending a peripheral portion of the base 24 at the angle to the base 24.

The female component 16 is comprised of a socket body 30. The socket body 30 may be integrally formed with one or more anti-rotation surfaces 32. The socket body has a central hole 34. A retaining element 18 fits in a slot 36 within the central hole 34. The retaining element 18 is configured to releasably engage the enlarged tip 14 of the shaft 26 when the shaft 26 is inserted into the central hole 34 of the socket body 30. The retaining element 18 may comprise a wire formed into an S shape and oriented in the socket body 30 such that one portion of the retaining element protrudes through the slot 36. The retaining element 18 may also have two or more protruding portions which extend into the central hole 34 of the socket body 30. As the shaft 26 is inserted into the central hole 34 of the socket body 30, the enlarged tip 14 of the stem 12 compresses and deflects the retaining element 18 outwards. Once the enlarged tip 14 of the shaft 26 is pushed past the retaining element 18, the retaining element 18 springs back to engage the underside 40 of the enlarged tip 14 of the shaft 26, which underside has a lesser diameter than the tip. This secures the male component 12 to the female component 16. To release the mechanical fastener 10, the shaft 26 is pulled away from the central hole 34, again compressing and deflecting the retaining element 18 as the enlarged tip 14 of the shaft 26 slides past it. Once the enlarged tip 14 has slid past the retaining element 18, the mechanical fastener 10 is unfastened and the retaining element 18 springs back to its original position.

The male component 12 and female component 16 may fasten one or more different materials. The materials may form a component of an article of clothing, bag, purse, shoe, or the like. Examples of types of materials compatible with a mechanical fastener 10 as described herein include any type of fabric, leather, simulated leather, plastic, rubber, metal, cardboard, and any combination of such materials. The male component 12 and female component 16 may be fastened to the materials by any method known in the art. Such methods include riveting, stitching, gluing, soldering, and welding.

Figure 3:
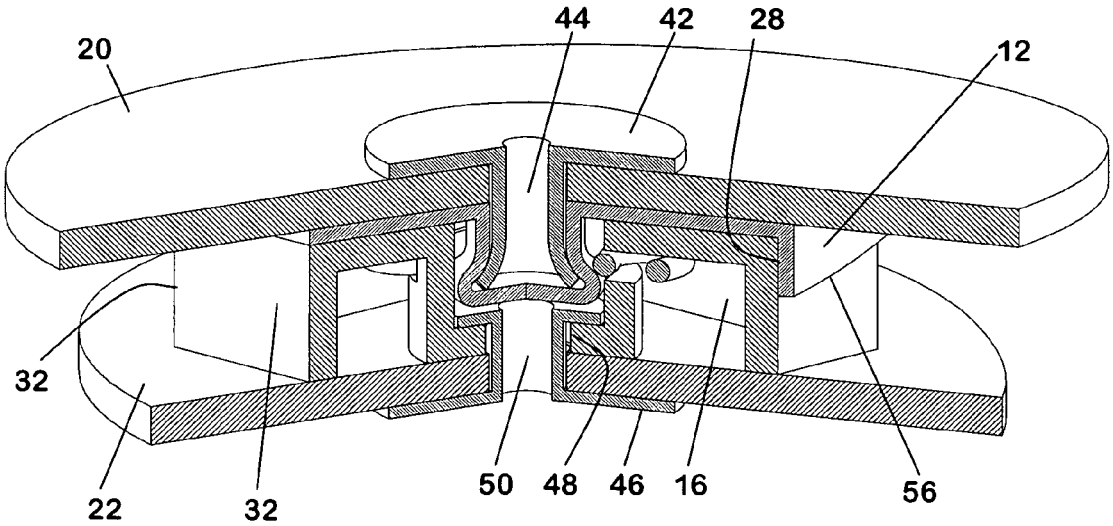
FIG. 3 is a cross sectional view of the mechanical snap fastener of FIG. 1 showing the components attached to material.

In the example of a mechanical fastener shown in FIG. 3, a male component 12 is secured to a first piece of material 20 by inserting a stem rivet 42 through the first material 20 and deforming a shaft 44 of the stem rivet 42 inside the hollow shaft 26, sandwiching the first material 20 between the male component 12 and the stem rivet 42. In a similar way, the female component 16 is affixed to a second material 22 by a socket rivet 46. The socket rivet 46 is inserted through the second piece of material 22 and a hole 48 in the female component 16. A shaft 50 of the socket rivet 46 is deformed, sandwiching the second piece of material 22 between the female component 16 and the socket rivet 46. The rivet attachment of both the male component 12 and female component 16 are accomplished using sufficient compressive force to ensure that, once attached, the male component 12 and female component 16 are not able to rotate about the first 20 and second 22 pieces of materials, respectively.

Figure 4:
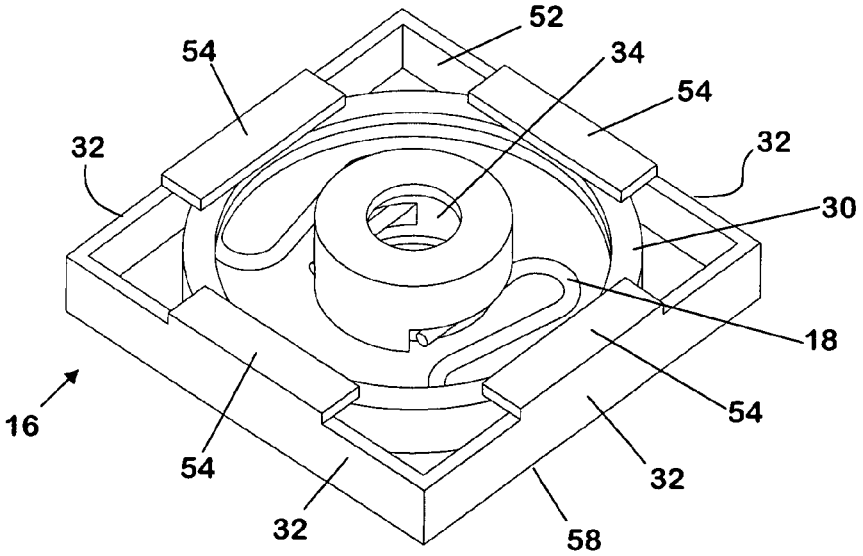
FIG. 4 is a perspective view of one embodiment of a female component for the mechanical snap fastener.

The male component 12 and female component 16 are each provided with at least one anti-rotation surface 28 and 32 oriented such that when an anti-rotation surface 28 of the male component 12 and an anti-rotation surface 32 of the female component 16 are engaged, relative rotation of the components is restrained or prevented. The anti-rotation surfaces 28 and 32 may be embodied in integral flanges or wings of the male component 12 or female component 16, as shown in FIG. 1, or may be embodied in an anti-rotation housing 52, as shown in FIG. 4. Although FIG. 4 shows an anti-rotation housing 52 enclosing a socket body 30, an anti-rotation housing similarly could enclose a base 24 and shaft 26 to form a male component 12.

In the example of a female component 16 shown in FIG. 4, the female component 16 is enclosed by an anti-rotation housing 52 having four anti-rotation surfaces 32 arranged about its periphery. The anti-rotation housing 52 also is provided with retaining tabs 54 which are crimped around the socket body 30 to secure the anti-rotation housing 52 over the socket body 30. The retaining tabs 54 are tightly crimped around the socket body 30 to ensure that the anti-rotation housing 52 is not able to rotate about the socket body 30.

Figure 2:
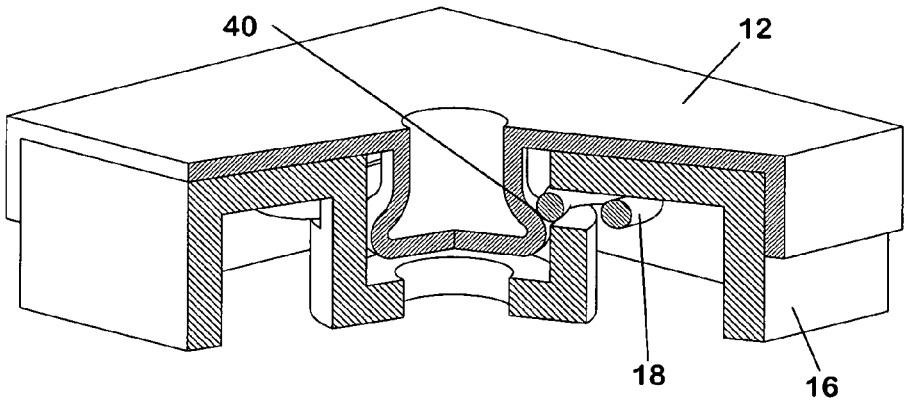
FIG. 2 is a cross sectional view of the mechanical snap fastener in FIG. 1 showing the components fastened together.
Figure 5:
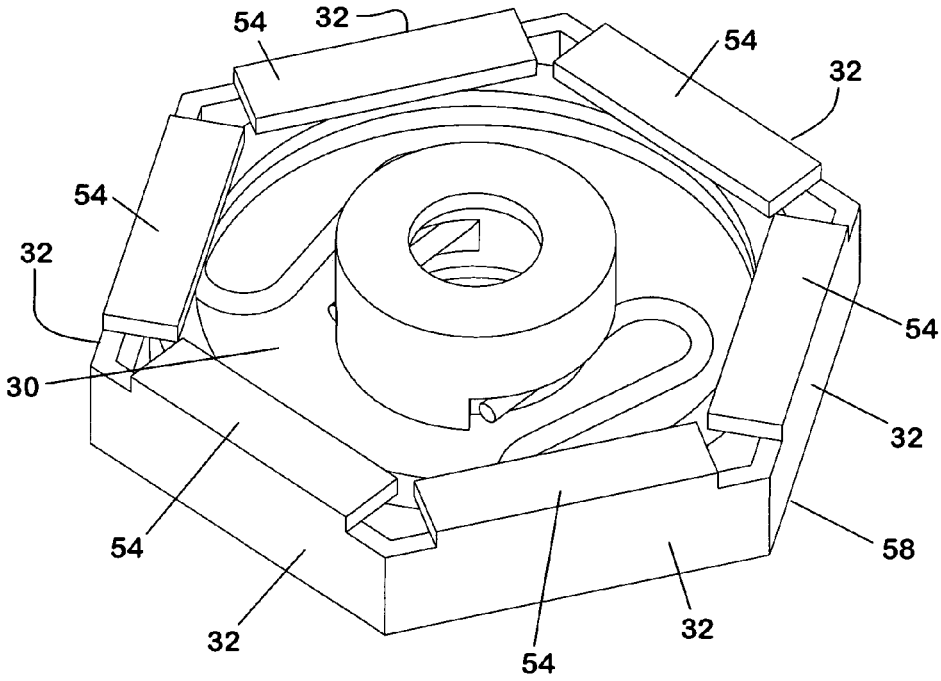
FIG. 5 is a perspective view of another embodiment of a female component for the mechanical snap fastener.

The male component 12 and female component 16 each may be provided with more than one anti-rotation surface 28 or 32. Further, the number of anti-rotation surfaces 28 included in the male component 12 need not be the same as the number of anti-rotation surfaces 32 included in the female component 16, as shown in FIG. 2 where the female component 16 includes four anti-rotation surfaces 32 while the male component 12 includes two surfaces 28. When fastened, the two anti-rotation surfaces 28 of the male component 12 engage two of the four anti-rotation surfaces 32 of the female component 16. In that configuration, the male component 12 and female component 16 may be engaged in two indexed orientations if the distances between opposite anti-rotation surfaces 32 of the female component 16 are equal. In a similar example, more indexed orientations may be added by increasing the number of anti-rotation surfaces 32 on the female component 16. For example, FIG. 5 shows a female component 16 comprised of an anti-rotation housing 52 which has six anti-rotation surfaces 32 enclosing a socket body 30. In another example, the male component 12 may be provided with more anti-rotation surfaces 28 than the female component 16 and the mechanical fastener 10 could similarly have multiple indexed orientations.

Figure 6:
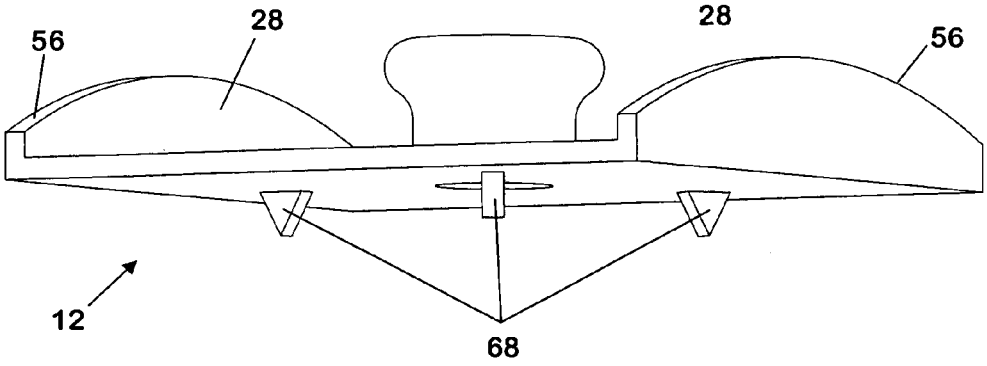
FIG. 6 is a perspective view of one embodiment of a male component for the mechanical snap fastener.

Many shapes of the anti-rotation surfaces 28 and 32 are possible. For example, the anti-rotation surfaces 28 and 32 may be provided with square corners or the outer edge 56 or 58 of the anti-rotation surface 28 or 32 may be curved, as shown in FIGS. 3 and 6. The shape of the anti-rotation surface 28 of the male component 12 need not be the same as the shape of an anti-rotation surface 32 of the female component 16. In the example of either the male component 12 or the female component 16 having an anti-rotation surface 28 or 32 with a curved outer edge 56 or 58 and the other of the male component 12 and the female component 16 having an anti-rotation surface 28 or 32 with square corners, alignment of the male component 12 to an indexed orientation relative to the female component 16 is made easier by the curved anti-rotation surface edge 56 or 58 bearing against the square corners of the opposing anti-rotation surfaces 28 or 32, rotating the male component 12 into an indexed position as it is forced towards the female component 16. An example of such a configuration is shown in FIG. 3, where the anti-rotation surfaces 28 of the male component 12 have a curved outer edge 56 and the anti-rotation surfaces 32 of the female component 16 have square corners.

The anti-rotation surfaces 28 and 32 of the male component 12 and female component 16 may have sufficient length to block the shaft of the male component 12 from entering the central opening of the female component 16 far enough for the retaining element 18 in the female component 16 to releasably retain the enlarged tip 14 of the shaft until the female component 16 and male component 12 are in an indexed position. In that configuration, fastening of the mechanical snap fastener is only possible when the male component 12 and female component 16 are in an indexed orientation relative to each other.

Figure 7:
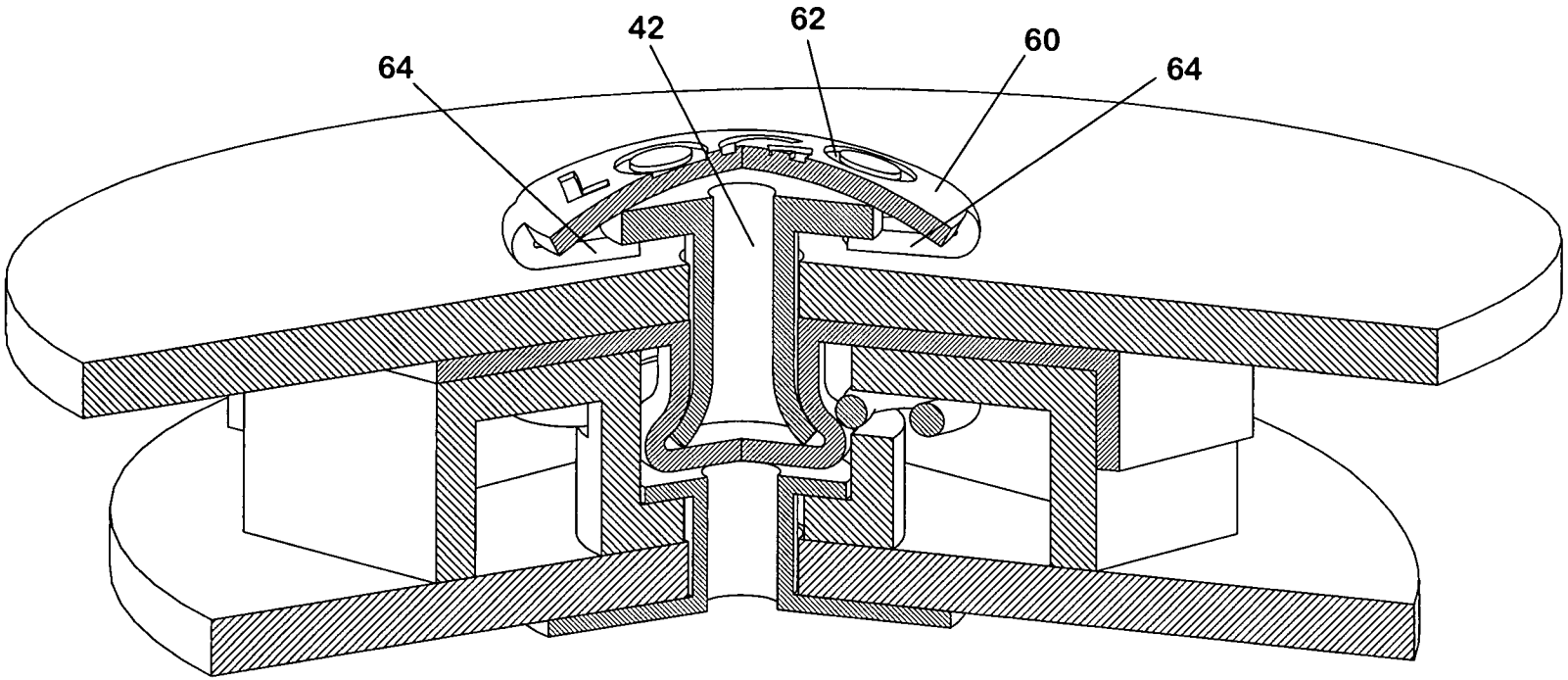
FIG. 7 is a cross sectional view of a mechanical snap fastener including an ornamental cap.

As shown in FIG. 7, a cap or ornament 60 may be added to either the male component 12 or female component 16 on the opposite side of the material 20 or 22 from the shaft 26 or central hole 34. The cap 60 may be provided with an embossed or painted design, a logo 62, an ornamental design or the like. In one example, the cap 60 is secured to the male component 12 by tabs 64 which are bent around the rivet 42 and the male component 12 is attached to a first piece of material 20 by a riveted attachment.

The male component 12, female component 16, stem rivet 42, socket rivet 46, anti-rotation housing 52, and anti-rotation washer 66 (FIG. 8) could be provided with one or more prongs 68 which penetrate into the material to further prevent rotation of the male component 12 or female component 16 about the material.

Figure 8:
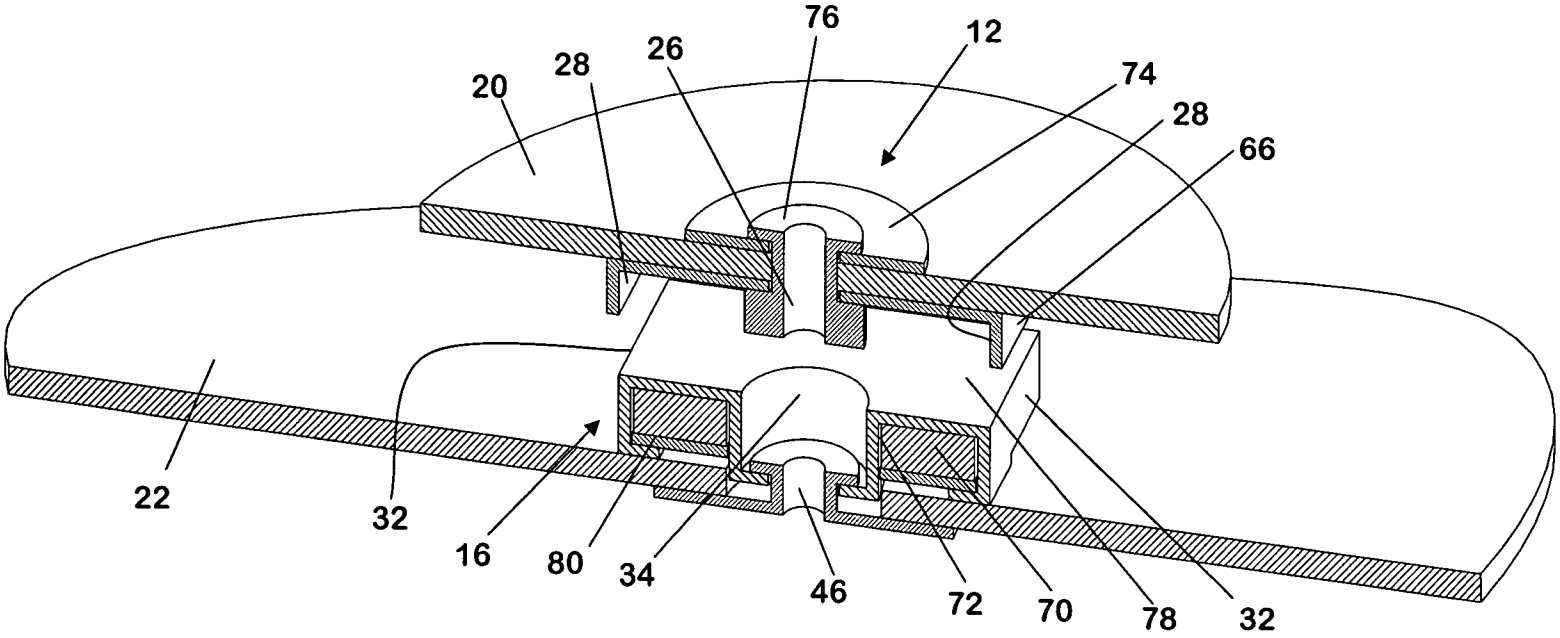
FIG. 8 is a cross sectional view of a magnetic snap fastener in accordance with the embodiment of the invention.

An example of a magnetic snap fastener in accordance with the invention is shown in FIG. 8. In this example, the female component 16 comprises, a toroidal magnet 70 with a central hole 72. A non-magnetic cover 78 circumscribes the magnet 70. The male component 12 comprises a base plate 74 with a shaft 76 which is configured to fit within the central hole 34 of the female component 16 when the male component 12 and female component 16 are brought into proximity. The magnet 70 attracts the base plate 74, releasably fastening a first sheet of material 20 to a second sheet of material 22.

As in the examples of the mechanical snap fasteners, the male component 12 and female component 16 of the magnetic snap fastener have anti-rotation surfaces 28 and 32, (FIG. 8).

In addition, the anti rotation surfaces of the present invention may also be adapted to mechanical ball and socket type snap fasteners.

In describing examples and exemplary embodiments, specific terminology is employed for the sake of clarity in this disclosure. However, the disclosure of this specification is not intended to be limited to the specific terminology so selected and it is to be understood that each specific element includes all technical equivalents that operate in a similar manner.

In addition, the embodiments and examples above are illustrative, and many variations can be introduced on them without departing from the spirit of the disclosure or from the scope of the appended claims. For example, elements and/or features of different illustrative and exemplary embodiments herein may be combined with each other and/or substituted for each other within the scope of this disclosure.

What is claimed is:

1. A mechanical snap fastener for holding two pieces of material together, comprising:

a male component comprising a base, a pin having an enlarged tip and a first anti-rotation surface displaced peripherally from the pin;

a female component comprising a retaining element for releasably holding the enlarged tip of the pin, a socket body having a central hole which receives the pin and into which the retaining element protrudes and a second anti-rotation surface displaced peripherally from the central hole, wherein the male component is attachable to a first piece of material, the female component is attachable to a second piece of material, the first anti-rotation surface of the male component and the second anti-rotation surface of the female component interact to prevent rotation of the male component relative to the female component when the components are fastened together, and at least one of the anti-rotation surfaces has a symmetrical curved outer edge configured to bear against an opposing male or female component to bring the male and female components into alignment when they are not aligned in an indexed fastening position, the at least one anti-rotation surface having a dimension measured between a base of the at least one anti-rotation surface and the curved outer edge which increases with distance away from ends of the curved outer edge.

2. The mechanical snap fastener of claim 1, wherein the first anti-rotation surface of the male component and the anti-rotation surface of the female component interact only at indexed fastening positions.

3. The mechanical snap fastener of claim 1, wherein the first anti-rotation surface of the male component and the second anti-rotation surface of the female component are configured so as not to allow the retaining element to releasably hold the enlarged tip if the pin is not in a predetermined position.

4. The mechanical snap fastener of claim 1, wherein the mechanical snap fastener further comprises a outer cap or ornament attached to one of the male component or the female component.

5. The mechanical snap fastener of claim 1, wherein the first anti-rotation surface of the male component is provided at a periphery of the base.

6. The mechanical snap fastener of claim 1, wherein the first or second anti-rotation surface of one of the male component and female component has a curved outer edge, the first or second anti-rotation surface of the other of the one of the male component and female component has square corners and each curved outer edge is configured to bear against the square corners of an opposing anti-rotation surface when the male and female components are not aligned in an indexed fastening position.

7. The mechanical snap fastener of claim 1, wherein the male component and female component comprise an unequal number of anti-rotation surfaces.

8. The mechanical snap fastener of claim 1 wherein the first anti-rotation surface of the male component is formed of a portion of the base bent at an angle relative to a main portion of the base.

9. The mechanical snap fastener of claim 1 wherein the pin is cylindrical.

10. A magnetic snap fastener for holding two pieces of material together, comprising:

a male component comprising a plate, a first anti-rotation surface and a pin;

a female component comprising a toroidal magnet, a cover for the toroidal magnet and a second anti rotation surface, the toroidal magnet and the cover both having a central hole which receives the pin, wherein the male component is attachable to a first piece of material, the female component is attachable to a second piece of material, the first anti-rotation surface of the male component and the second anti-rotation surface of the female component interact to prevent rotation of the male component relative to the female component when the components are fastened together, and at least one of the anti-rotation surfaces has a symmetrical curved outer edge configured to bear against an opposing male or female component to bring the male and female components into alignment when they are not aligned in an indexed fastening position, the at least one anti-rotation surface having a dimension measured between a base of the at least one anti-rotation surface and the curved outer edge which increases with distance away from ends of the curved outer edge.

11. The magnetic snap fastener of claim 10, wherein the first anti rotation surface of the male component and the second anti rotation surface of the female component interact only at indexed fastening positions.

12. The magnetic snap fastener of claim 10 wherein the first anti-rotation surface of the male component is displaced peripherally from the pin of the male component and the second anti-rotation surface of the female component is displaced peripherally from the central hole of the toriodal magnet and the cover.

13. The magnetic snap fastener of claim 10 wherein the central hole is configured to surround the pin.

* * * * *